US006663305B2

(12) United States Patent
Poulos

(10) Patent No.: US 6,663,305 B2
(45) Date of Patent: Dec. 16, 2003

(54) MULTIPLE MARKER HOLDER

(76) Inventor: Peter D. Poulos, 436 Howard St., Ventura, CA (US) 93003

( * ) Notice: Subject to any disclaimer, the term of this patent is extended or adjusted under 35 U.S.C. 154(b) by 0 days.

(21) Appl. No.: 10/038,077

(22) Filed: Jan. 7, 2002

(65) Prior Publication Data

US 2003/0129013 A1 Jul. 10, 2003

(51) Int. Cl.[7] ..... B43K 27/00; B43K 27/04

(52) U.S. Cl. ..... 401/19; 15/435; 15/444; 211/69.1; 401/17; 401/34; 401/88; 401/98; 401/131; 401/192; D19/36

(58) Field of Search ..... 401/17, 19, 20, 401/34, 88, 98, 131, 192; 15/435, 444; 211/69.1; D19/36

(56) References Cited

U.S. PATENT DOCUMENTS 4,415,092 A * 11/1983 Boyer ..... 401/88 X
6,149,330 A * 11/2000 Chuang ..... 401/34 X

* cited by examiner

*Primary Examiner*—Gregory L. Huson
*Assistant Examiner*—Kathleen J. Prunner
(74) *Attorney, Agent, or Firm*—Albert O. Cota

(57) ABSTRACT

A holder that is designed to hold within a single molded structure up to four marking implements such as a carpenter's pencil or a lumber crayon. The marker holder, which is configured to resemble a Greek cross, consists of a vertical tube having a rectangular or circular cross-section, a right wall and a left wall. To the two walls is respectively attached a right horizontal tube and a left horizontal tube. Each tube includes a set of marker support tabs that grip and accessively retain the carpenter's pencil and the lumber crayon.

6 Claims, 2 Drawing Sheets

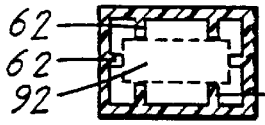
FIG. 3
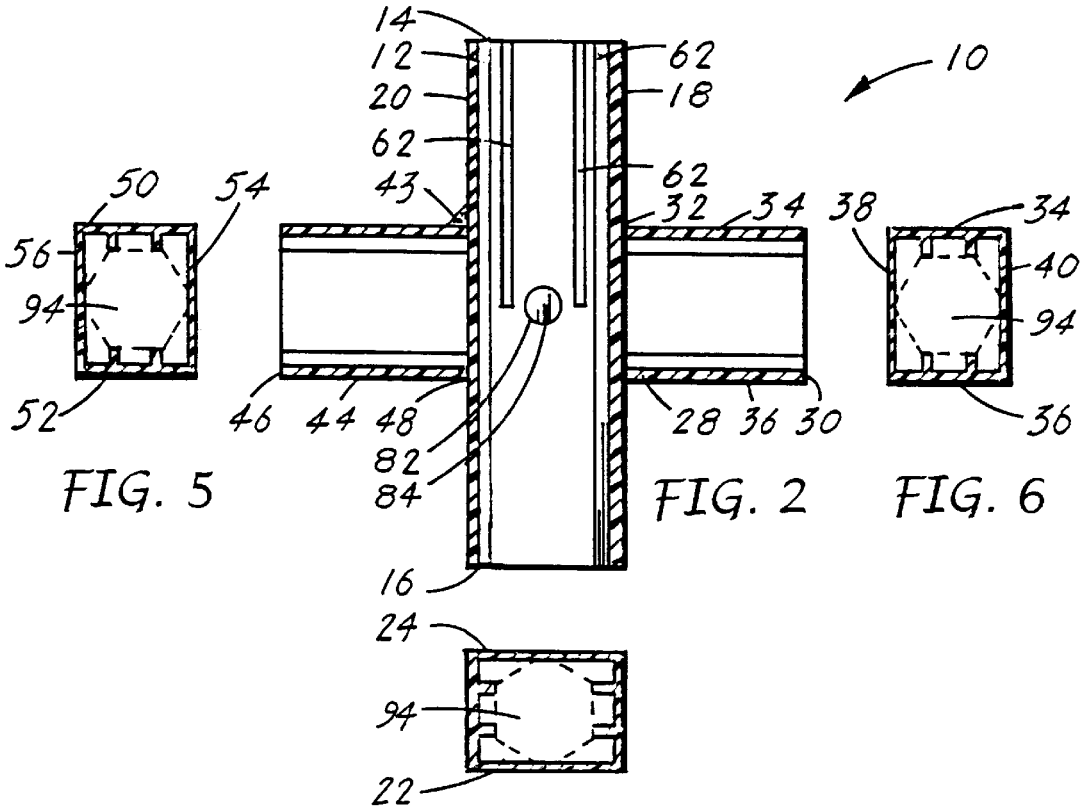
FIG. 5
FIG. 2
FIG. 6
FIG. 4
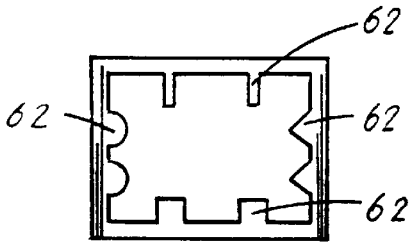
FIG. 8
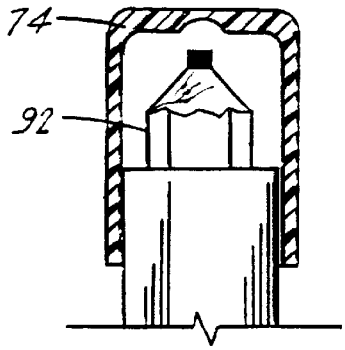
FIG. 9

MULTIPLE MARKER HOLDER

TECHNICAL FIELD

The invention pertains to the general field of writing implements and more particularly to a holder designed to retain a plurality of writing implements.

BACKGROUND ART

Most professions, especially trade groups such as carpentry, utilize distinct tools that are designed to accomplish the unique work required in the trade. It has been discovered, that certain tools or items can be used with equal effectiveness by different trade groups. One such item is a construction marker, which is commonly referred to as a keel or a lumber crayon. The keel, which is best described an an oversized oil crayon is a very effective means by which an item, such as lumber may be marked.

The "marks" can include measurements, identifications, instructions or any other written indication that facilitates a construction job. The reason keels are so widely used is that they are better than a conventional pen or pencil for use in a construction environment, where the markings are often exposed to inclement weather, walked/scuffed on, or many other occurrences that would erase or damage a pen or a pencil mark.

Keel are especially popular with carpenters and masons, both of whom must mark any number of individual components, such as pieces of lumber or blocks, that are being used. It has been found to be even more effective to use different colored keels for various identification purposes. For example, all lumber that will be used to frame bedroom windows, during a house construction, are marked with a yellow keel. This has proven to be such a common practice that there are now established colors for particular construction tasks.

One drawback to using keels, especially different colors, is that the keels must be carried at almost all times. Most construction workers use a belt having multiple bags or pouches that are attached, which can carry tools, nails, or any other required item(s). Many workers have tried to carry a few individual keels in their bags, along with other items since it is not practical to have a single keel-only bag. Unfortunately, the keels can get lost or severely damaged by coming in contact with the other tools/item. Also, it requires time to search through the bags for other correct color keel when needed.

Obviously, if there were some way by which multiple keels could be kept and carried together during a construction job, it would save time and allow for easier use. Additionally, by including multiple colored keels in one unit, the benefits would be substantial. It would also help to include other writing implements, such as a lumber crayon, together with a keel or keels, in that way, any marking or writing job could be accomplished quickly and easily, with minimum effort.

A search of the prior art did not disclose any patents that read directly on the claims of the instant invention, however the following U.S. patents are considered related:

| U.S. pat. No. | INVENTOR | ISSUED |
|---|---|---|
| 6,269,960 | Harp | 7 Aug. 2001 |
| 5,791,798 | Yu | 11 Aug. 1998 |
| D319,261 | Lee | 20 Aug. 1991 |

The U.S. Pat. No. 6,269,960 patent discloses a felt tip marker holder which includes a flexible base having a top base end and a bottom base end. A plurality of felt tip receivers are attached to the bottom base end and a flexible flap is connected to the top base end. A first locking member is connected to the flexible flap, and a second locking member is connected to the base. The felt tip receivers include a reception well which is complimentary to a tip portion of the felt tip marker.

The U.S. Pat. No. 5,791,798 patent discloses a multipurpose writing instrument having a series of writing tips for various uses. The instrument includes a hollow tubular mounting section having a mounting wall surrounding a hole. The upper end of the mounting wall forms a mounting step with inner threads, and a lower section of the mounting wall extends downward to form a straight section having a tip hole. The outer surface of the lower section of the mounting wall forms an insert surface and an insert step, which is joined to outer threads before extending to a tapered end. The outer diameter of the insert surface corresponds to the diameter of the mounting hole. The size of the writing tip matches the tip hole so that it fits firmly into the tip hole.

The U.S. Pat. No. D319,261 design patent discloses a combined plural crayon storage housing. The housing includes a center housing, a front crayon holder and a rear crayon holder. The center housing is dimensioned to receive, at each end, one end of a sharpened crayon. Over each of the held crayons is then inserted the front and rear crayon holder that allows the point of the crayons to be exposed for use.

For background purposes and as indicative of the art to which the invention is related, reference may be made to the remaining cited patents.

| U.S. pat. No. | INVENTOR | ISSUED |
|---|---|---|
| 6,276,854 | Mullins | 21 Aug. 2001 |
| 6,241,410 | Hager | 5 Jun. 2001 |
| 5,839,712 | Wang | 24 Nov. 1998 |
| 5,779,381 | Muelver | 14 Jul. 1998 |
| 5,662,423 | Walden | 2 Sep. 1997 |
| 5,468,083 | Chesar | 21 Nov. 1995 |
| 4,290,707 | Ariga | 22 Sep. 1981 |

DISCLOSURE OF THE INVENTION

The multiple marker holder in its basic design is comprised of a plurality of spaced tubes where in each tube includes a means for frictionally retaining a marker. The marker comprises a flat carpenter's pencil and a set of lumber crayons which are also known as "keel".

The preferred design, which is constructed of a rigid plastic, is comprised of four equidistant tubes, that are spaced 90-degrees of form an equidistant Greek cross. Within each tube is a set of support tabs that extend longitudinally and function to frictionally retain the pencil or crayon. The support tabs are relatively thin to allow flexure when the pencil or crayon is inserted into the respective tube openings.

To enhance the utility of the multiple marker holder, a cap, which is dimensioned to fit over the tube opening that retains the carpenter's pencil, may be employed. The external wall of the marker holder can also have attached a spring clip that allows the holder to be attached to a belt. And finally, the sides of the holder can be molded to include a gripping surface consisting of dimples or a set of thin protrusions.

In view of the above disclosure, the primary object of the invention is to produce a multiple marker holder having means for holding up to four markers which include a flat carpenter's pencil and three lumber crayons.

In addition to the primary object of the invention, it is also an object of the invention to produce a multiple marker holder that:

- can be produced in a transparent plastic to show the wear of a particular marker, or can be produced in a variety of colors,
- is designed to facilitate removing used markers and inserting new markers.
- can be used by several trades such as carpenters, plumbers, masons and the like,
- is conductive for use as a premium item,
- is easy to carry in a pouch or in a pocket,
- is easy to manipulate the holder to a specific colored marker, and
- is cost effective from both a manufacturers and consumer points of view.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 2 is a side elevational view of the rectangular marker holder of FIG. 1.

FIG. 3 is a top plan view of the upper edge of the vertical tube showing a flat carpenter's pencil retained within the opening.

FIG. 4 is a bottom plan view of the lower edge of the vertical tube shown a lumber crayon retained within the opening.

FIG. 5 is a left side elevational view of the left horizontal tube showing a lumber crayon retained within the opening.

FIG. 6 is a right side elevational view of the right horizontal tube showing a lumber crayon retained within the opening.

FIG. 8 is an end view of a tube illustrating the various configurations available for a marker support tab.

FIG. 9 is a partial elevational view of a vertical section designed to accept a marker protective cap.

BEST MODE FOR CARRYING OUT THE INVENTION

Figure 1:
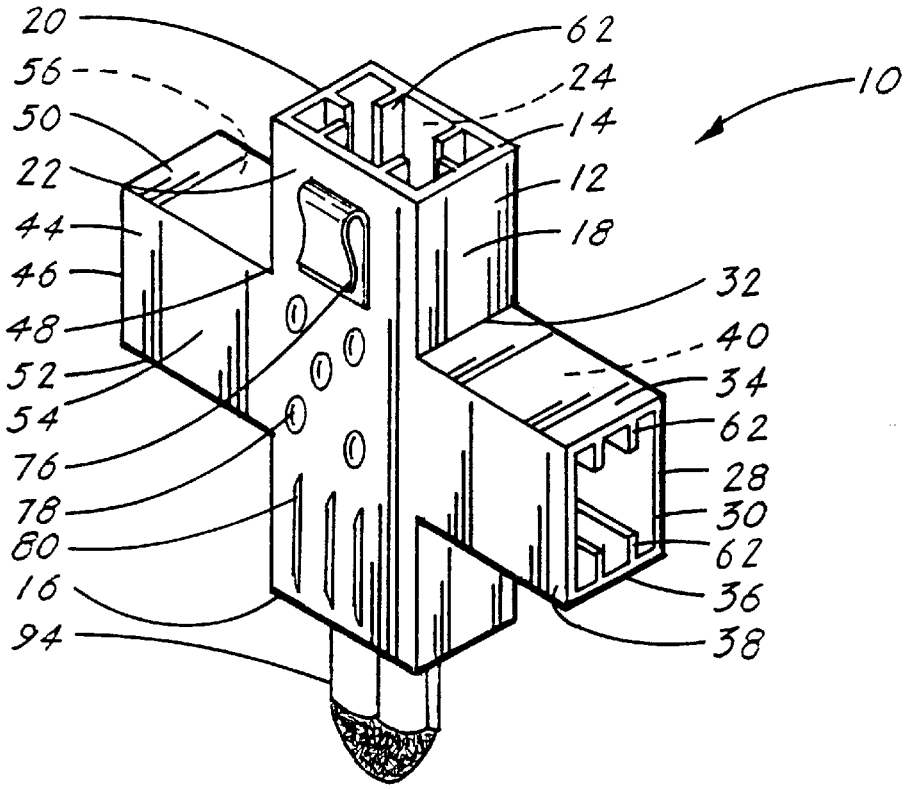
FIG. 1 is a perspective view of a multiple marker holder having a rectangular vertical tube with a pair of rectangular horizontal tubes attached to form a substantial Greek cross.

The best mode for carrying out the invention is presented in terms of a preferred embodiment for a multiple marker holder 10. The marker holder 10 is designed to be comfortably held and to include a plurality of markers that are used by various trades and especially carpenters, to place a mark that designates a particular task or measurement. The preferred embodiment, as shown in FIGS. 1–9, is preferably comprised of an integral structure consisting of a vertical tube 12 having attached a right horizontal tube 28 and a left horizontal tube 44. The multiple marker holder 10, as shown in FIG. 2, substantially has the shape of a Greek cross.

The vertical tube 18, as shown in FIGS. 1–4, includes an upper edge 14, a lower edge 16, a right wall 18, a left wall 20, a front wall 22 and a rear wall 24.

The right horizontal tube 28, as shown in FIGS. 1, 2 and 6, includes an outer edge 30, an inner edge 32, an upper wall 34, a lower wall 36, a front wall 38 and a rear wall 40. The inner edge 32 is substantially centered and attached, by an attachment means 41, to the right wall 18 of the vertical tube 12.

The left horizontal tube 44, as shown in FIGS. 1, 2 and 5, includes an outer edge 46, an inner edge 48, an upper wall 50, a lower wall 52, a front wall 54 and a rear wall 56. The inner edge 48 of the left horizontal tube 44 is substantially centered and attached, by the attachment means, to the left wall 20 of the vertical tube 12.

The attachment means is preferably achieved by a molding process that integrally attaches the right and left horizontal tubes 28, 44 to the right wall 18, and left wall 20 respectively of the vertical tube 12. However, the vertical tube 12 and the right and left horizontal tubes 28, 44 can also consist of individual structures. In this design, the horizontal tubes are attached to the sides of the vertical tube 12 by an attachment means 41 consisting of an adhesive 43 as shown in FIG. 2.

Figure 7:
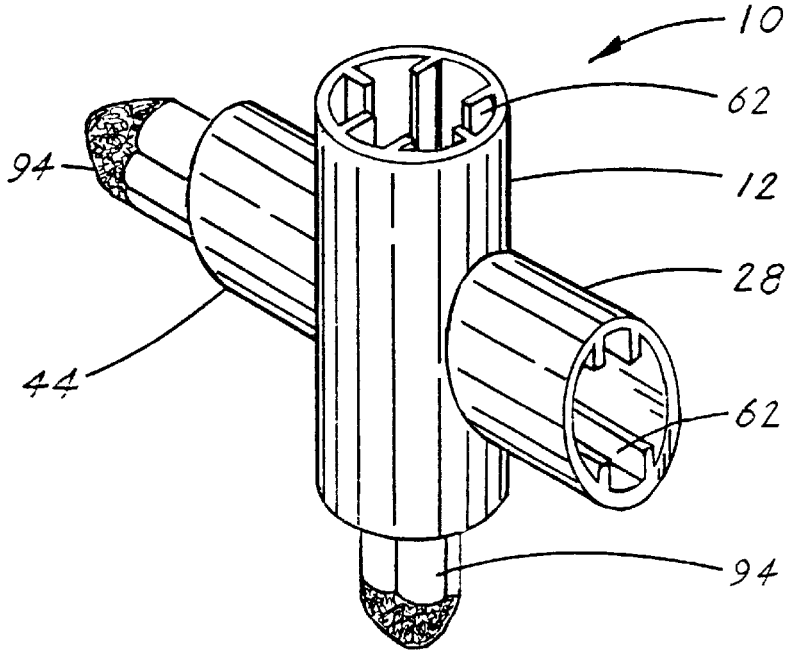
FIG. 7 is a perspective view of a multiple marker holder having a circular vertical tube with a pair of horizontal tubes attached to form a substantial Greek cross.

The vertical tubes 12 and the right and left horizontal tubes 28, 44 can be produced with a rectangular cross-section as shown in FIGS. 1–4, or a circular/elliptical cross-section as shown in FIG. 7.

In either case, the multiple marker holder 10 is preferably molded of a rigid plastic, however, a resilient plastic, a metal or a wood can also be used. Additionally, the plastic can be transparent in which case the amount of marker 90 remaining in a tube can be determined or the plastic can be molded in a color that corresponds to or is favored by a particular trade group.

The vertical tube 12 and the right and left horizontal tubes 28, 44 whether they have a rectangular shape, as shown in FIG. 1, or a circular/elliptical shape, as shown in FIG. 7, include within their respective openings a means for frictionally retaining a marker consisting of a carpenter's flat pencil 92 or a set of lumber crayons 94.

The marker retaining means as shown in FIGS. 1–8, is comprised of a set of marker support tabs 62 that extend longitudinally along the tube openings of the spaced tubes 12, 28, 44.

In a preferred marker support tab 62 configuration there are at least a pair of substantially centered marker support tabs 62 that extend longitudinally from the upper edge 14 of the front and rear wall 22, 24 to the substantial center of the vertical tube 12, as shown best in FIGS. 2 and 3; at least one substantially centered support tab 62 that extends longitudinally from the upper edge 14 to the lower edge 16 of the right and left walls 18, 20 of the vertical tube 12, as also shown in FIGS. 2 and 3; at least a pair of substantially centered support tabs 62 that extend longitudinally from the outer edges 30, 46 of the upper wall 34 and lower wall 52 of the right horizontal tube 28 and the left horizontal tube 44 as shown in FIGS. 2, 5 and 6.

The marker support tabs 62 can be made in several cross-section designs. For example, a rectangular cross-section as shown on the upper surface of FIG. 8; a square cross-section, as shown on the lower surface of FIG. 8; a radiused cross-section, as shown on the left surface of FIG. 8; and a triangular cross-section, as shown on the right surface of FIG. 8. One set of support tabs 62 on one side of the vertical tube 12 is dimensioned to retain the flat carpenter's pencil 92 as shown by the broken lines in FIG. 3. The opposite side of the vertical tube 12 and the right and left horizontal tubes 28, 44 have support tabs 62 that are dimensioned to frictionally retain the lumber crayon 94, which typically has a hexagon shape as shown by the broken lines in FIGS. 4, 5 and 6.

The carpenter's pencil 92 and the color of the lumber crayons 94 are selected to identify a particular task. For example, in the carpentry trade, a blue crayon is typically used to mark King stud locations; a black crayon is typically used to mark the location of normal studs, center marks and other detailing sites; and a red crayon is typically used to mark various construction channels.

To further increase the utility, the multiple marker holder 10 can be designed to include a marker protective cap 74, as shown in FIG. 9. The cap 74 is dimensioned to fit and be releasably attached over the tube opening that retains the flat carpenter's pencil 92. A spring clip 76 can also be attached to the front or rear wall on the marker holder 10, as shown in FIG. 1. The clip 76 allows the holder 10 to be clipped to a belt or a pouch. As also shown in FIG. 1, to the external wall(s) of the marker holder 10 can be included at least one dimple 78 or a set of thin, elongated protrusions 80. The dimple(s) or protrusions function as a finger gripping surface. And finally, as shown in FIG. 2, through the front wall 22 and the rear wall 24 of the vertical tube 12 can be located a rod bore 82 that is longitudinally and laterally centered. Through the bore 82 is frictionally inserted and attached a support rod 84 that functions to support the lower end of the flat carpenter's pencil 92 or lumber crayon 94.

While the invention has been described in complete detail and pictorially shown in the accompanying drawings it is not to be limited to such details, since many changes and modifications may be made in the invention. For example, the multiple marker holder 10 can have walls that are radiused or that are molded in other geometric designs. Also, the marking implements can also consist of fluid markers, chalk or other forms of marking implements. Hence, it is described to cover any and all modifications and from which may come within the language and scope of the appended claims.

What is claimed is:

1. A multiple marker holder comprising:

a) a vertical tube haying an upper edge, a lower edge, a right wall, a left wall, a front wall and a rear wall, b) a right horizontal tube having an outer edge, an inner edge, an upper wall, a lower wall, a front wall and a rear wall, wherein the inner edge is substantially centered and attached, by an attachment means, to the right wall of said vertical tube, c) a left horizontal tube having an outer edge, an inner edge, an upper wall, a lower wall, a front wall and a rear wall, wherein the inner edge is substantially centered and attached, by an attachment means, to the left wall of said vertical tube, d) at least a pair of substantially centered marker support tabs that extend longitudinally from the upper edge of the front and rear walls of said vertical tube to the substantial center of said vertical tube, e) at least one substantially centered support tab that extends longitudinally from the upper edge to the lower edge of said vertical tube and from the right and left walls of said vertical tube, f) at least a pair of substantially centered support tabs that extend longitudinally from the outer edges of said right and left horizontal tubes and from the upper and lower walls of said right and left horizontal tubes, wherein:

(1) the upper edge of said vertical tube having an opening that is dimensioned to frictionally retain a flat carpenter's pencil and (2) the lower edge of said vertical tube, the outer edge of said right horizontal tube, and the outer edge of said left horizontal tube each having an opening that is dimensioned to frictionally retain a lumber crayon.

2. The marker holder as specified in claim 1 wherein said vertical tube, said right horizontal tube, and said left horizontal tube each have a rectangular cross-section.

3. The marker holder a specified in claim 2 wherein said holder is molded of a rigid plastic.

4. The marker holder as specified in claim 3 wherein said vertical tube, said right horizontal tube, and said left horizontal tube are spaced to form a Greek cross.

5. The marker holder as specified in claim 1 wherein said vertical tube, said right horizontal tube, and said left horizontal tube each have a circular cross-section.

6. The marker holder as specified in claim 1 wherein said vertical tube further includes:

a) a rod bore longitudinally and laterally centered through the front wall and rear wall, and b) a support rod frictionally inserted through and attached to the rod bore, wherein said support rod supports the lower end of a flat carpenter's pencil and a lumber crayon.

* * * * *